US007770823B2

(12) United States Patent
Kubota et al.

(10) Patent No.: US 7,770,823 B2
(45) Date of Patent: Aug. 10, 2010

(54) FUEL INJECTOR AND ITS STROKE ADJUSTMENT METHOD

(75) Inventors: Eiichi Kubota, Ishioka (JP); Hideyuki Shikaki, Midori (JP); Masahumi Nakano, Hitachi (JP); Masahiko Hayatani, Munich (DE)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 12/129,053

(22) Filed: May 29, 2008

(65) Prior Publication Data

US 2008/0296414 A1 Dec. 4, 2008

(30) Foreign Application Priority Data

May 31, 2007 (JP) ..... 2007-144349

(51) Int. Cl.
*B05B 1/30* (2006.01)
*B05B 1/34* (2006.01)
*B05B 1/00* (2006.01)

(52) U.S. Cl. ..... 239/533.14; 239/533.2; 239/585.1; 239/533.12; 239/88; 239/600

(58) Field of Classification Search ..... 239/88–91, 239/585.1–585.51, 533.14; 251/118–127, 251/214
See application file for complete search history.

(56) References Cited

U.S. PATENT DOCUMENTS

| | | | | |
|---|---|---|---|---|
| 4,399,944 | A | 8/1983 | Krauss et al. | |
| 5,713,523 | A | 2/1998 | Fujikawa | |
| 5,746,376 | A * | 5/1998 | Romann et al. | 239/585.4 |
| 5,787,583 | A | 8/1998 | Wolf et al. | |
| 6,224,002 | B1 * | 5/2001 | Reiter | 239/585.3 |
| 6,402,061 | B1 * | 6/2002 | Fukutomi et al. | 239/585.1 |
| 6,405,942 | B1 * | 6/2002 | Ruehle et al. | 239/102.2 |
| 6,786,432 | B1 * | 9/2004 | Reiter | 239/585.1 |
| 6,834,667 | B2 * | 12/2004 | Sumiya et al. | 137/315.01 |
| 6,910,642 | B2 * | 6/2005 | Maier | 239/585.1 |
| 2008/0061171 | A1 * | 3/2008 | Bayer | 239/585.3 |

FOREIGN PATENT DOCUMENTS

| | | | |
|---|---|---|---|
| JP | 57-70951 | A | 5/1982 |
| JP | 61-85567 | A | 5/1986 |
| JP | 8-189439 | A | 7/1996 |
| JP | 9-500435 | A | 1/1997 |
| JP | 2003-56430 | A | 2/2003 |
| JP | 2004-232464 | A | 8/2004 |

OTHER PUBLICATIONS

Japanese Office Action dated Sep. 15, 2009 with English translation (Four (4) pages).

* cited by examiner

*Primary Examiner*—Len Tran
*Assistant Examiner*—James S Hogan
(74) *Attorney, Agent, or Firm*—Crowell & Moring LLP

(57) ABSTRACT

A fuel injector comprises a movable element, a seat contact surface formed at one end of the movable element, a nozzle member having a valve seat. The seat contact surface of the movable element is in contact with and seated on at the time of valve closing. A nozzle holder portion holds a periphery of the nozzle member. A plastic deformation portion is formed by engaging one of a part of the nozzle member and a part of the nozzle holder portion in the other one of the part of the nozzle member. The nozzle member and the nozzle holder portion are joined by welding.

6 Claims, 7 Drawing Sheets

FUEL INJECTOR AND ITS STROKE ADJUSTMENT METHOD

CLAIM OF PRIORITY

The present application claims priority from Japanese patent application serial no. 2007-144349, filed on May 31, 2007, the content of which are hereby incorporated by reference into this application.

FIELD OF THE INVENTION

The present invention relates to a fuel injector used in an internal combustion engine.

BACKGROUND OF THE INVENTION

A patent document 1 (Japanese Published Unexamined Patent Application No. 2004-232464) discloses a fuel injector having the following structure. A swirler for forming a swirl fuel flow and an orifice plate (nozzle member) are put on a ring-shaped prominence for a swirler placement provided in a bottom of a nozzle member (nozzle holder) so as to keep a clearance between a nozzle member-inner diameter and a swirler-outer diameter. The orifice plate is temporarily press-fitted into the nozzle member. In this status, a positioning guide pin, which has an approximately the same diameter as a swirler inner diameter, is inserted in a through hole of the swirler such that a pin end becomes in contact with a valve seat. Thereafter, the orifice plate is press-fitted so as to hold the swirler between the nozzle member and the orifice plate, and temporary positioning is performed between the valve seat formed on the orifice plate and the swirler inner diameter. At this time, even when a center shift occurs between the valve seat and the swirler inner diameter, the center shift is absorbed with the clearance between the nozzle inner diameter and the swirler outer diameter.

Finally, from the status of this temporary positioning, the orifice plate is further press-fitted, thereby the swirler is engaged in the ring-shaped prominence on the swirler placement surface provided in the nozzle member, and the nozzle and the swirler are coaxially assembled. At this time, as the swirler held between the nozzle member and the orifice plate is constrained in a diameter direction by engagement in the ring-shaped projection, the concentricity between the swirler inner diameter and the valve seat can be maintained even when the positioning guide pin is pulled out.

Further, even when variation in height occurs among the nozzle, the swirler and the orifice plate, as the swirler is engaged in the ring-shaped prominence provided in the nozzle member, the entire height of the joined nozzle, the swirler and the orifice plate can be adjusted to a predetermined measurement.

The fuel injection in patent document 1 has a stopper as a stroke end of the movable valve (movable element) in a middle portion of the movable valve in its axial direction. Further, when the swirler and the orifice plate (nozzle member) have been built in the nozzle member (nozzle holder), the nozzle member is built on a yoke via the stopper in a stroke direction of the movable valve. In this structure, generally, the stoke of the movable valve is adjusted with the thickness of the stopper.

Further, in patent document 1, the swirler is engaged in the ring-shaped prominence on the swirler placement surface provided in the nozzle, and the entire height of the joined nozzle, the swirler and the orifice plate is adjusted to a predetermined measurement, however, the engagement of the orifice plate provided with the valve seat in the nozzle holding the orifice plate is not disclosed.

Accordingly, in patent document 1, there is no description about adjustment of stroke amount of the movable valve (movable element) with the amount of engagement between the nozzle member (nozzle holder) and the orifice plate (nozzle). Further, in a case where the nozzle member (nozzle holder) and the orifice plate (nozzle member) are welded, even when the orifice plate is press-fitted into the nozzle member, a relative positional relation between the nozzle member and the orifice plate may be shifted. This is not taken into consideration.

The present invention has been made in consideration of the above situation, and provides a fuel injector in which a stroke of a movable element can be infallibly adjusted and a stroke adjustment for the fuel injector.

SUMMARY OF THE INVENTION

The present invention is basically constructed as follows.

A fuel injector comprises a movable element, a seat contact surface formed at one end of the movable element, a nozzle member having a valve seat which the seat contact surface of the movable element is in contact with and seated on at the time of valve closing, and a nozzle holder portion to hold a periphery of the nozzle member;

wherein a plastic deformation portion, formed by engaging one of a part of the nozzle member and a part of the nozzle holder portion in the other one of the part of the nozzle member and the part of the nozzle holder portion in a stroke direction of the movable element, is provided, and wherein the nozzle member and the nozzle holder portion are joined by welding.

In the fuel injector, it is preferable that the nozzle member is press-fitted into the nozzle holder.

Further, it is preferable that the nozzle member and the nozzle holder are joined and sealed with a ring-shaped welding bead at the location on the farther side of pressure transmission from the inside of the fuel injector than the plastic deformation portion.

Further, it is preferable that the amount of engagement between the nozzle member and the nozzle holder portion is equal to or greater than 15 μm and equal to or less than 350 μm in an axial direction of the fuel injector, and the overlap amount thereof in a radial direction of the fuel injector is equal to or greater than 0.02 mm and equal to or less than 0.5 mm.

Further giving a concrete example, a fuel injector comprises a movable element, a seat contact surface formed at one end of the movable element, a nozzle member having a valve seat which the seat contact surface of the movable element is in contact with and seated on at the time of valve closing, a nozzle holder portion to hold a periphery of the nozzle member, an electromagnetic circuit including a movable core provided at the other end of the movable element, a spring to press the movable element in a valve seat direction, an electromagnetic coil to attract the movable core and pull up the movable element with an attraction force overcoming a pressing force of the spring, and a stationary core. Additionally, a pull-up limit position of the movable element is set by contact between the movable core and the stationary core. Furthermore a plastic deformation portion, formed by engaging one of a part of the nozzle member and a part of the nozzle holder portion in the other of the part of the nozzle member and the part of the nozzle holder portion in a stroke direction of the movable element, is provided.

Further giving a concrete example, a fuel injector comprising a movable element, a seat contact surface formed at one end of the movable element, a nozzle member having a valve seat which the seat contact surface of the movable element is in contact with and seated on at the time of valve closing, a nozzle holder portion to hold a periphery of the nozzle member, a guide member installed in the nozzle member, a movable core connected to another end side of the movable element, a spring that presses the movable element in a valve seat direction, and an electromagnetic circuit having an electromagnetic coil that attracts the movable core and pulls up the movable element against a force of the spring at the time of being energized and a stationary core, and a collision surface against which the movable core collides at the time of being pulled-up to determine a pull-up limit position of the movable element. Additionally, the nozzle member is press-fitted into the nozzle holder portion, and a corner of a flange provided on one end side or the periphery of the nozzle member is engaged in a corner provided in an inner surface or one end side of the nozzle holder portion, and at least the corner on the nozzle holder portion side is plastic-deformed and a crushed portion is formed. Furthermore, the nozzle member and the nozzle holder portion are joined and sealed with a ring-shaped bead formed by laser welding or electronic beam welding.

Further, provided is a stroke adjustment method for the above-mentioned fuel injector according to the present invention, wherein a stroke of the movable element is adjusted by adjusting the amount of engagement between the nozzle member and the nozzle holder portion.

Further, provided is a stroke adjustment method for the above-mentioned fuel injector according to the present invention, wherein a stroke of the movable element is adjusted by adjusting a flow amount by changing a valve opening amount of the movable element by adjusting the amount of engagement between the nozzle member and the nozzle holder portion.

According to the present invention, as the amount of engagement between the nozzle member and the nozzle holder has an effect on the stroke of the movable element, the present invention provides a fuel injector in which the stroke of the movable element can be infallibly adjusted and a stroke adjustment for the fuel injector.

DETAILED DESCRIPTION OF THE PREFERRED EMBODIMENTS

Figure 1:
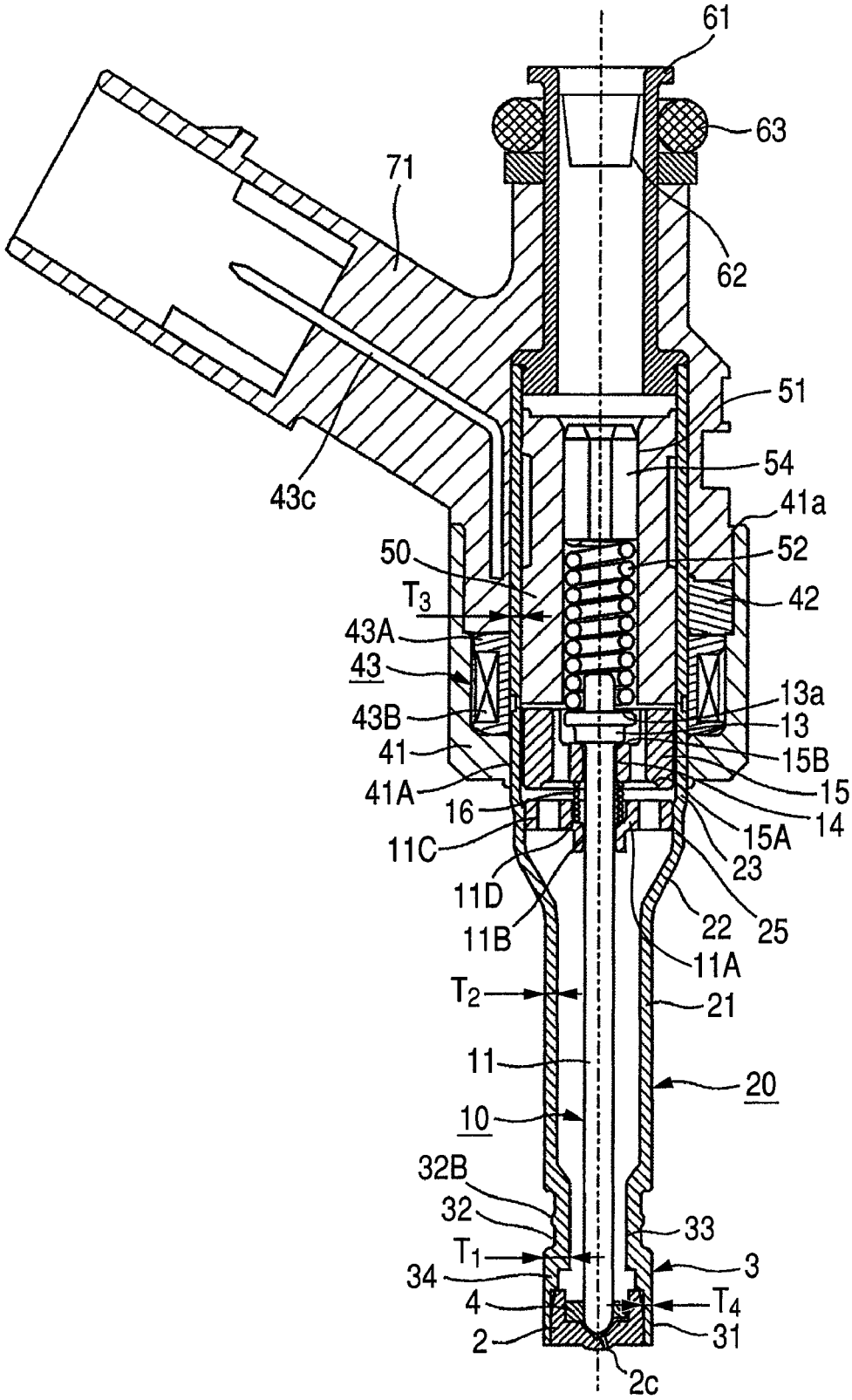
FIG. 1 is a cross-sectional view of a fuel injector according to a first embodiment of the present invention.

The embodiments of the present invention have the following features.

The first feature is that the periphery of a nozzle member is press-fitted into a nozzle holder for improvement in strength of nozzle support structure, improvement in sealing reliability, improvement in positioning accuracy including concentricity with the nozzle holder, and for practical application with high-pressure fuel. Further, a corner (A) of a step provided in one end or periphery of the nozzle member is engaged with a corner (B) provided in an inner surface or one end of the nozzle holder and at least the corner (B) is plastic-deformed and a crushed portion is formed. In addition, the nozzle member and the nozzle holder are joined and sealed with a ring-shaped welding bead by laser welding or electronic beam welding.

The second feature is that, in addition to the first feature, the nozzle member and the nozzle holder are joined and sealed with a ring-shaped bead at the location on the farther side of pressure transmission from the inside of the fuel injector than the crushed portion.

The third feature is that, in addition to the first and second features, for further optimization of achievement of the object, the amount of engagement of the (A) in the corner (B) is equal to or greater than 15 μm and equal to or less than 350 μm in an axial direction of the fuel injector, and the amount of overlap in a radial direction of the fuel injector is equal to or greater than 0.02 mm and equal to or less than 0.5 mm.

The fourth feature is that in any one of the first, second and third features, a stroke is adjusted by adjusting the amount of engagement of the corner (A) in the corner (B), for realizing high-accuracy stroke adjustment in a movable valve and improvement in economical efficiency.

The fifth feature is that, in addition to any one of the first, second and third features, the stroke is adjusted by adjusting the amount of engagement of the corner (A) in the corner (B), so as to change a valve opening amount of the movable valve and adjust the flow amount, for realizing high-accuracy flow-amount adjustment in the fuel injector and improvement in economical efficiency.

The above features obtain the following advantages.

The first advantage is that, as the periphery of the nozzle is press-fitted into the nozzle holder and the corner of the step provided in the end or periphery of the nozzle is engaged in the nozzle holder side, these members are simultaneously constrained in two surfaces in radial direction and axial direction, and supporting rigidity is greatly increased. Further, as the axis of the nozzle member is brought into correspondence with the axis of the nozzle holder in the press-fitted process prior to the engagement and this status is maintained when the nozzle is press-fitted in the axial direction and the engagement is made, high-accuracy concentricity is ensured. Further, as the plastic deformation occurred in the engagement process applies a circumferentially uniform reaction force to the nozzle member, the nozzle member can be prevented from leaning. Further, as the engagement portion is formed such that the nozzle holder is crushed and the nozzle member is dented, the strength of the nozzle in a pullout direction is increased. Accordingly, even when high pressure is applied to the inside of the fuel injector, the nozzle cannot be easily moved. Further, as the crushed portion blocks fuel, and prevents flow of the fuel to the downstream side of the crushed portion (far side from the inside of the fuel injector) and reduces pressure of the fuel, withstand pressure to the high pressure is further improved. Further, in a case where the nozzle member and the nozzle holder are joined and fixed by laser welding or electronic beam welding, when no above-described engagement portion is formed and the nozzle is merely press-fitted, the nozzle and nozzle holder may be moved and twisted by the action of dilation and contraction due to heat, dissolution and coagulation of the welded portion, and the accuracy is degraded. On the other hand, in the present invention, as the engagement portion firmly holds the positional relation between the nozzle holder and the nozzle member, these are not moved and the high accuracy can be maintained. Further, as welding is made after the engagement, the welded portion is not damaged thereafter.

The second advantage is that, in addition to the above-described first advantage, as the nozzle member and the nozzle holder are joined and sealed with a ring-shaped welding bead at the location on the farther side of pressure transmission from the inside of the fuel injector than the crushed portion, the load on the welded portion can be reduced by blocking or reduction of the fuel pressure in the crushed portion. Accordingly, further high pressure can be handled, and the durability of the welded portion can be improved. Further, the welding bead portion can be downsized, thus a low-output and downsized welder can be used, and welding spatter can be reduced.

The third advantage is that a lower limit value of crush amount necessary for appropriately holding the nozzle and a limit of engagement load not to damage the fuel injector main body are clarified. This builds the nozzle without damaging the fuel injector main body in a status close to a top product in a fuel injector assembly process. Further, as cleaning solvent can be flown through a hole of the nozzle holder (in which the nozzle member is fitted) immediately before the nozzle is built in and foreign particles inside the fuel injector can be removed, various problems such as endless blowing due to clogging with foreign particles can be solved.

The fourth advantage is that the stroke of the movable valve is adjusted by adjustment of the amount of engagement, the nozzle can be positioned with high accuracy by a similar advantage to the above-described first advantage. Further, as clear correlation can be established among the nozzle pressing load, the amount of engagement and the stroke, control can be easily made and fine adjustment can be performed. Accordingly, high-accuracy and efficient stroke adjustment can be realized. Further, when the nozzle member and the nozzle holder are joined and fixed by laser welding or electronic beam welding after the adjustment, the nozzle member is not moved by the above-described second advantage, and the change of the stroke can be suppressed to a minimum amount. Further, the above-described third advantage can be similarly obtained. Further, according to this arrangement, a member for stroke adjustment such as a spacer can be omitted, thus the number of parts can be reduced.

The fifth advantage is that as the flow amount in the fuel injector is adjusted by changing the stroke of the movable valve by adjustment of the amount of engagement, the nozzle member can be positioned with high accuracy by a similar advantage to the above-described first advantage. Further, as clear correlation can be established among the nozzle pressing load, the amount of engagement and the stroke and between the stroke and the flow amount, control can be easily made and fine adjustment can be performed. Accordingly, high-precision and economically advantageous flow amount adjustment can be realized. Further, when the nozzle member and the nozzle holder are joined and fixed by laser welding or electronic beam welding after the adjustment, the nozzle is not moved by the above-described second advantage, and the change of the stroke, by extension, the change of flow amount, can be suppressed to a minimum amount. Further, the above-described third advantage can be similarly realized, and a high-performance fuel injector with a stable flow amount can be obtained.

Hereinafter, an embodiment of the present invention will be described in detail in accordance with the drawings.

First Embodiment

In the present embodiment, the present invention is applied to an electromagnetic fuel injector having an electromagnetic coil, which is used for an internal combustion engine. The electromagnetic coil is energized to attract a movable core to a stationary core and non-energized to move away from the stationary core. A movable element with a valve head at its end can have a stroke motion in accordance with the movement of the movable core at this time. The stroke motion of the movable element opens and closes a fuel injection orifice provided at the end of a nozzle member, and fuel is injected from the injection orifice. Note that in the present embodiment, the length from a fuel inlet port at one end to the fuel injection orifice at the other end is long, and as a result, an electromagnetic fuel injector in which the length of the movable element is long, i.e., a so-called long type electromagnetic fuel injector is employed.

Figure 2:
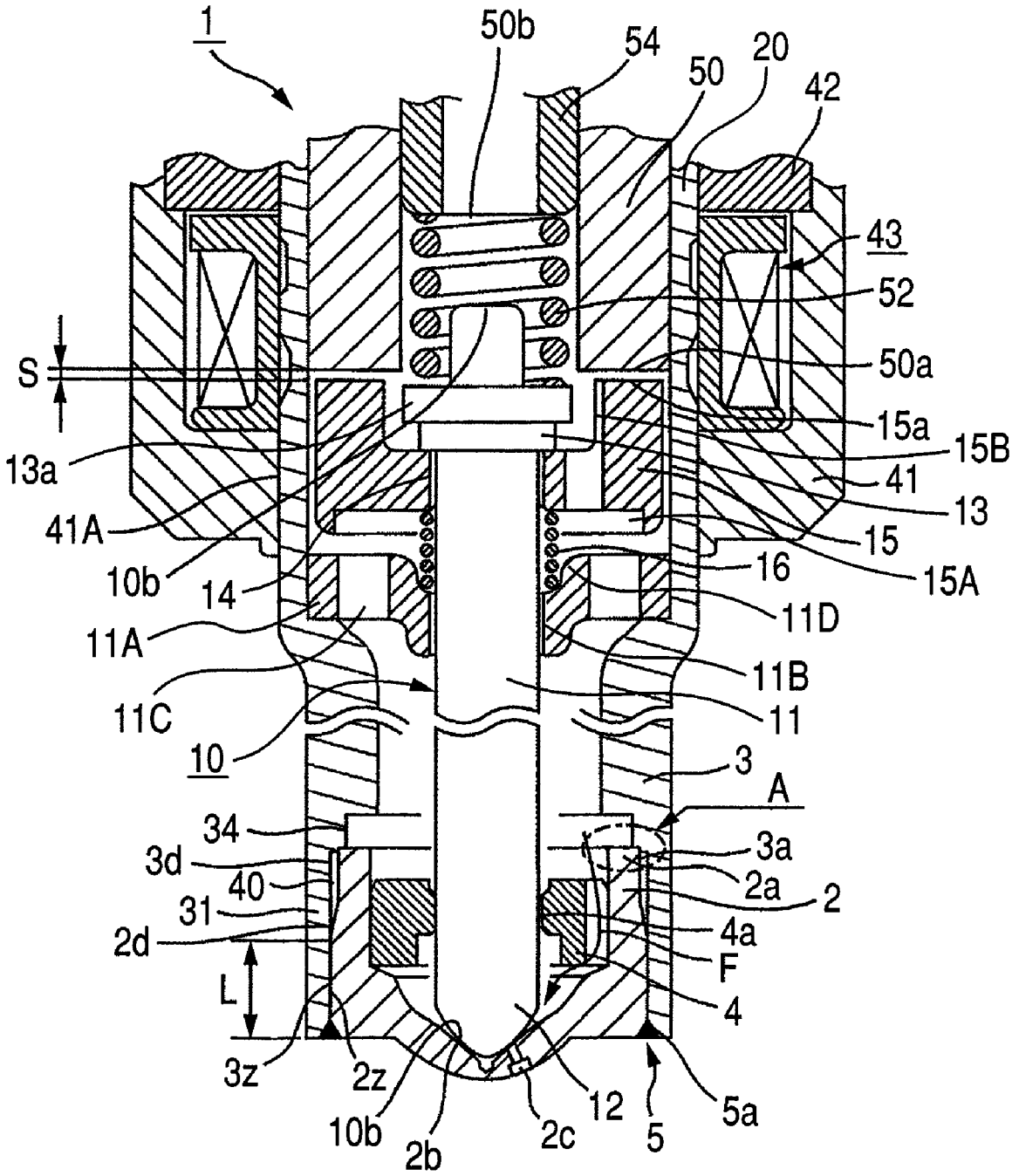
FIG. 2 is a cross-sectional view of a part of the fuel injector in FIG. 1.

FIG. 1 is a longitudinal cross-sectional view of the fuel injector according to the present embodiment. FIG. 2 is an enlarged cross-sectional view of a part of the fuel injector in FIG. 1. Hereinafter, the entire structure of the electromagnetic fuel injector of the present embodiment will be described in accordance with FIGS. 1 and 2.

A metal cylindrical casing 20 has a small-diameter cylindrical portion 21 and a large-diameter cylindrical portion 23. The both cylindrical potions 21 and 23 are formed with a single-piece construction and a tapered portion 22 is formed between them. A nozzle holder portion 3 is formed at tip of the small-diameter cylindrical portion 21.

A guide member 4 for a valve head and a nozzle member 2 are inserted in a cylindrical part 31 formed at the tip of the nozzle holder portion 3. The guide member 4 guides of a valve rod 11 of a movable element 10, and guides the fuel from the outside in a radial direction to the inside as indicated with an arrow F in FIG. 2. The valve head 12 is formed at the tip of the valve rod 11. The nozzle member 2 is provided with a fuel injection orifice 2C formed with a tilt angle with respect to a central axis of the valve rod 11.

The fuel injection orifice 2C is formed as a stepped through hole with a small diameter on the entrance side (valve head side) and a large diameter on the exit side. The number of fuel injection orifices 2C may be single or plural. Otherwise, the injection orifice 2C may be formed in parallel with the central axis of the valve rod 11.

In the nozzle member 2, a tapered valve seat 2*b* is formed on the side facing the guide member 4. When the valve is closed, a tapered face (seat contact surface) 10*a* of the valve head 12 is in contact with the valve seat 2*b* to stop the flow of the fuel, and when the valve is opened, the tapered face 10*a* guides the flow of the fuel indicated with the arrow F to the fuel injection orifice 2C.

The nozzle holder portion 3 has a thickness T1 greater than other thicknesses $T_2$ to $T_4$ of the metal cylindrical casing 20 such that an annular groove 32 is formed in the outer surface of the nozzle holder portion 3 and resin chip seal or a seal member typified by a gasket as a metal member with rubber bonded to its periphery (not shown) is fitted in the annular groove 32. A ring-shaped slight prominence 32B is provided in the center of the annular groove 32, thereby movement of the seal member in a thrusting direction is stopped. Thus the slight prominence 32B functions a dropout preventing function upon installation of the fuel injector to installation hole of an engine cylinder head or a cylinder block.

After attachment of the seal member, the outer diameter of the sealed portion is larger than the outer diameter of the nozzle holder portion 3. Accordingly, the seal member is in press-contact with an inner wall of the installation hole of the cylinder head or the cylinder block. Thus, the function of the seal is achieved in a status where high pressure in a combustion chamber acts. On the other hand, as the outer diameter of the nozzle holder portion 3 and the outer diameter of the small-diameter cylindrical portion 21 are slightly smaller than the diameter of the installation hole of the cylinder head or the cylinder block, the nozzle holder portion 3 and the small-diameter cylindrical portion 21 are inserted to the insertion hole with a annular gap.

In the nozzle holder portion 3, a fuel annular channel having a uniform cross section is formed between the periphery. of the valve rod 11 and the surface of a narrowed-down inner diameter portion 33 whose opposite side is the annular groove 32.

The inner diameter of the nozzle holder portion 3 is largest in the cylindrical part 31, and this part's inside is formed as an insertion portion for the nozzle member 2 with the guide member 4.

The outer diameter of the cylindrical part 31 of the nozzle holder portion 3 is uniform to the end, and the inner diameter of the nozzle member-insertion portion of the cylindrical part 31 is largest in the cylindrical part 31 such that the thickness $T_4$ thereof is less than the other thicknesses $T_1$ to $T_3$. Further, an inner surface-step portion 34 is formed between the other thickness $T_1$ portion and the thickness T4 portion (nozzle member-insertion portion) in the cylindrical part 31. A corner 3*a* is formed with the step portion 33, and as described later, the nozzle member 2 is located and fixed by utilizing the corner 3*a*.

In an inside-lower end part of the large-diameter cylindrical portion 23 of the metal cylindrical casing 20, a valve rod guide 11A to guide the valve rod 11 is press-fitted into a draw-processed part 25 of the large-diameter cylindrical portion 23. In the valve rod guide 11A, a guide hole 11B to guide the valve rod 11 is provided in the central portion, and plural fuel channels 11*c* are provided as through holes around the guide hole 11B. A hollow portion 11D is formed by extruding in an upper surface (a surface on the movable core 15 side) of the central portion of the valve rod guide 11A. A spring 16 is held with the hollow portion 11D. In a central-lower surface (a surface on the nozzle member 2 side) of the valve rod guide 11A, a cylindrical-protruded portion opposite to the hollow portion 11D is formed by extruding, and the guide hole 11B of the valve rod guide 11 is provided in a central portion of the cylindrical-protruded portion. The needle-type valve rod 11 is guided with the guide hole 11B of the valve rod guide 11A and the guide hole of the guide member 4 so as to be able to move straightly.

In this manner, as the metal cylindrical casing 20 is integrally formed with one piece from its one end to the other end in the axial direction, the parts of the fuel injector can be easily managed, and further, good assembly operability can be obtained.

A flange portion 13 having an outer diameter larger than the diameter of the valve rod 11 is provided at one end side opposite to the valve head 12 in the valve rod 11. A stopper in the movable core 15 is formed with the flange portion 13. Further, a spring seat 13*a* for a first spring 52 is formed on the flange portion 13. The diameter of the spring seat 13*a* is greater than that of the stopper in the flange portion 13 to be in contact with the movable core 15.

The movable element 10 has the movable core 15 with a through hole 14 through which the valve rod 11 is inserted in the center. In the movable core 15, a hollow portion 15A for spring reception in its central portion on the side facing the valve rod guide 11A, and the spring 16 is held between the hollow portion 11D of the valve rod guide 11A and the hollow portion 15A.

As the diameter of the through hole 14 of the movable core 15 is smaller than that of the cylindrical flange portion 13, under the action of a pressing force of the spring 52 (first spring) pressing the valve rod 11 toward the valve seat 2*b*, the movable core 15 held with the spring 16 (second spring) is in contact and engaged with a lower end surface of the flange portion 13. In the movable core 15, a hollow portion 15B is formed in its surface facing the stationary core 50 side, and the bottom surface of the hollow portion 15B is in contact with the lower end surface of the flange portion 13.

In this arrangement, regarding upward movement of the movable core 15 against the pressing force of the spring 52 or downward movement of the valve rod 11 following the pressing force of the spring 52, the both movable core 15 and valve rod can move together in the axial direction. However, when a force to move the valve rod 11 upward or a force to move the movable core 15 downward regardless of the pressing force of the spring 52 respectively acts on the both members independently, the valve rod 11 and the movable core 15 move in mutually opposite directions.

At this time, the lower end surface of the movable core 15 faces to the upper end surface of the valve rod guide 11A. However, as the spring 16 is interposed between these members (15, 11A), the both members are not in contact with each other.

The stationary core 50 is pressed into the inner side of the large-diameter cylindrical portion 23 of the metal cylindrical casing 20, and weld-joined in a press-insertion contact position.

One end of the spring 52 (first spring) for initial load setting is in contact with the upper end surface of the flange portion 13 of the valve rod 11, and the other end is received with an adjustment element 54 pressed into an upper end of the through hole 51, thereby the spring 52 is held between the flange portion 13 and the adjustment element 54. The initial load of pressing of the valve rod 11 by the spring 52 against the valve seat 2*b* can be adjusted by adjusting a fixed position of the adjustment element 54.

As shown in FIG. 2, in a status where the initial load of the spring 52 is adjusted, the lower end surface of the stationary core 50 faces to the upper end surface of the movable core 15 with a magnetic gap S of about 20 to 100 μm (exaggerated in the figure).

A fuel filter 62 is installed to the upper end inner side of a fuel guide pipe 61, and an O-ring 63 is attached to the periphery of the fuel introduction pipe 61.

A cup-shaped yoke 41 and a ring-shaped yoke (core plate) 42 to cover an open side of the yoke 41 are fixed to the periphery of the large-diameter cylindrical portion 23 of the metal cylindrical casing 20. A through hole 41A is provided in the center of the bottom of the cup-shaped yoke 41, and the large-diameter cylindrical portion 23 of the metal cylindrical casing 20 is inserted through the through hole 41A.

A cylindrical electromagnetic coil 43 is provided in cylindrical space formed with the cup-shaped yoke 41 and the ring-shaped yoke 42. The electromagnetic coil 43 has a ring-shaped coil bobbin 43A having a cross-section with a U-shaped groove opened outward in the radial direction and a ring-shaped coil 43B of copper wire coiled in the groove. A terminal conductor 43C having rigidity is fixed to the beginning and the end of the ring-shaped coil 43B, and the terminal conductor 43C is pulled out from a through hole provided in the ring-shaped yoke 42. The conductor body 43C is molded with resin and covered with a resin molded body 71.

When the electromagnetic coil 43 is energized, a magnetic attraction force is generated between the movable core 15 of the movable element 10 and the stationary core 50 in the magnetic gap S, and the movable core 15 is attracted with a force greater than the set load of the spring 52 and moved upward. At this time, the movable core 15, which is engaged with the flange portion 13 of the valve rod, is moved upward together with the valve rod 11, and is moved until the upper end surface of the movable core 15 collides with the lower end surface of the stationary core 50. As a result, the valve head 12 moves away from the valve seat 2*b*, the fuel passes through the fuel channel F, and is injected from the fuel injection orifice 2*c* in the combustion chamber.

When the energization of the electromagnetic coil 43 is stopped, the magnetic attraction force in the magnetic gap S disappears. In this status, the spring force of the spring 52 to press the cylindrical flange portion 13 of the valve rod 11 in the opposite direction overcomes the force of the spring 16 and acts on the movable element 10. As a result, the movable element 10 is pressed to a closing position in which the valve head 12 is in contact with the valve seat 2*b*, with the spring force of the spring 52. At this time, the flange portion 13 is engaged with the movable core 15. The movable core 15 overcoming the force of the spring 16 moves to the valve rod guide 11A side.

When the valve head 12 energetically collides with the valve seat 2*b*, the valve rod 11 is rebounded in a direction to compress the spring 52. However, as the movable core 15 is a separate member of the valve rod 11, the valve rod 11 moves separately from the movable core 15 in a direction opposite to the movement of the movable core 15. At this time, friction by fluid occurs between the outer surface of the valve rod 11 and the inner surface of the movable core 15, and the energy of the rebounding valve rod 11 is absorbed with the inertial mass of the movable core 15 still moving in the opposite direction (valve closing direction). As the movable core 15 with large inertial mass is separated from the valve rod 11 upon rebound, the rebound energy itself is reduced.

Further, as the inertial force of the movable core 15 that absorbed the rebound energy of the valve rod 11 is reduced by the energy, the energy to compress the spring 16 is reduced and the repulsive force of the spring 16 is reduced. Accordingly, the phenomenon that the valve rod 11 is moved in a valve opening direction by the rebound of the movable core 15 itself does not occur.

Figure 3:
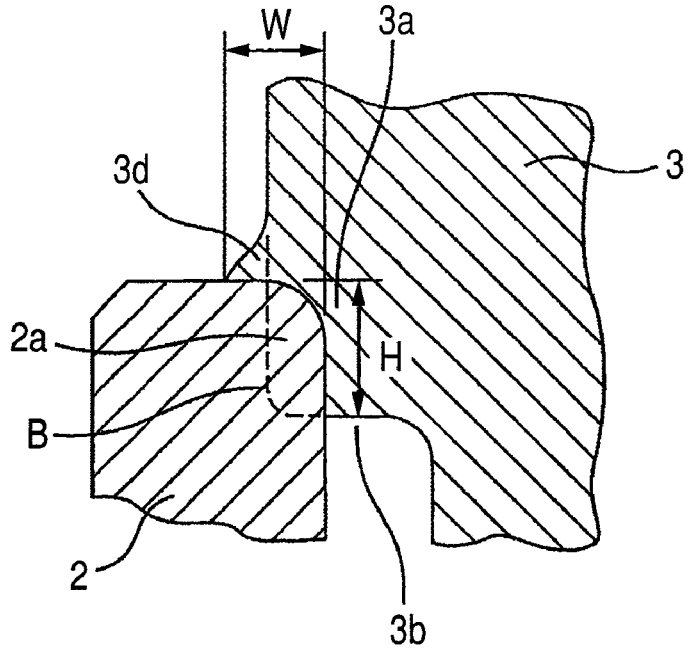
FIG. 3 is an enlarged cross-sectional view of a part A of the fuel injector in FIG. 2.

Next, the details of the nozzle holder portion in which the guide member 4 and the nozzle member 2 are assembled will be described using FIGS. 2 and 3. Note that FIG. 3 is an enlarged cross-sectional view of a part A of the fuel injector in FIG. 2.

A peripheral surface 2*z* of the nozzle member 2 is press-fitted by a section of a length L into an inner surface 3*z* of the nozzle holder portion 3. At this time, as shown in FIG. 3, the corner 2*a* of the end surface of the nozzle member 2 is engaged with the corner 3*a* of the lower end surface of the inner surface in the cylindrical part 31 of the nozzle holder portion 3. By the engagement, the corner 3*a* is plastic-deformed from a shape indicated with a broken line B, and a crushed portion 3*d* is formed. The crushed portion 3*d* is formed by plastic deformation of the corner 3*a* of the nozzle holder portion 3 in the process from the contact between the corner 2*a* of the nozzle member 2 and the lower end surface 3*b* of the nozzle holder portion 3 to the engagement to the illustrated position.

Further, the nozzle member 2 and the nozzle holder portion 3 are joined and sealed with a ring-shaped bead 5*a* formed by laser welding on the outside from the engagement portion.

The assembly process for them has steps of press-fitted →engagement→laser welding.

In the present embodiment, the nozzle member 2 is in two-surface simultaneous constraint status in the radial direction and axial direction, and the rigidity to support the nozzle member 2 is greatly increased. Further, as an axis of the nozzle member 2 is brought into correspondence with an axis of the inner side 3*z* of the nozzle holder portion 3 at the press-insertion process prior to the engagement and this status is maintained while the nozzle member is pressed in the axial direction and the engaged portion is formed, high-accuracy concentricity can be kept. Further, as the plastic deformation occurs at the engagement process applies a circumferentially uniform reaction force to the nozzle member 2, the nozzle member can be prevented from leaning. Further, the engaged portion is formed such that the nozzle holder portion 3 is crushed and the nozzle member 2 is dented into the crushed portion, the strength of the nozzle member 2 in its pullout direction is increased. Accordingly, even when high fuel-pressure is applied to the inside of the fuel injector, the nozzle member 2 can maintain the fixed status securely. Further, as the crushed portion 3*d* blocks fuel, prevention of flow of the fuel to the press-insertion portion between the outer surface 2*z* of the nozzle member 2 and the inner surface 3*z* of the nozzle holder portion 3 and reduction of pressure of the fuel can be expected. Further, improvement in withstand pressure to the high pressure can be expected. Further, when joining the nozzle member 2 with the nozzle holder portion 3 by laser welding, unless the above-mentioned engagement portion is provided, the nozzle member 2 and nozzle holder portion 3 may be moved and twisted by the action of dilation and contraction due to heat, dissolution and coagulation of the welded portion. In this embodiment, as the nozzle member 2 is firmly held to the nozzle holder portion 3 with the engagement portion, a relative positional shift does not easily occur between the nozzle member 2 and the nozzle holder portion 3. During the welding process, the relative positional relation between the nozzle member 2 and the nozzle holder portion 3 can be maintained with high accuracy. Further, as welding is made after the engagement of the nozzle member 2 in the nozzle holder portion 3, the welded portion 5 is not damaged thereafter.

Further, as the nozzle member 2 and the nozzle holder portion 3 are joined and sealed with the ring-shaped welding bead 5*a* at the location on the farther side of pressure transmission from the inside of the fuel injector than the crushed portion (plastic deformation portion) 3*d*, the load on the welded portion 5 can be reduced by blocking or reduction of fuel pressure by the crushed portion 3*d*. Accordingly, high pressure can be handled, and the durability of the welded portion 5 can be improved. Further, the welding bead portion 5*a* can be downsized, thus a low-output and downsized welder can be used, and welding spatter can be reduced.

In the present embodiment, the amount of engagement of the corner 2*a* of the nozzle member 2 in the corner 3*a* of the nozzle holder portion 3 is equal to or greater than 15 μm and equal to or less than 350 μm in the axial direction of the fuel injector, and the amount of overlap between the corner 2*a* and the corner 3*a* in the radial direction (radiational direction from the central axis) of the fuel injector is equal to or greater than 0.02 mm and equal to or less than 0.5 mm. This clarifies a lower limit value of crush amount necessary for appropriate holding of the nozzle member 2 and a limit of engagement load not to damage the fuel injector main body. Further, the nozzle member 2 can be built without damaging the fuel injector main body in a status close to atop product in a fuel injector assembly process. Further, as cleaning solvent is flown through the cylindrical part 31 of the nozzle holder portion 3 (in which the nozzle is inserted) immediately before the nozzle member 2 is built in and foreign particles inside the fuel injector can be removed, various problems such as endless blowing due to clogging with foreign particles can be solved.

Further, the peripheral surface 2*d* of the nozzle member 2 close to the corner 2*a* has a diameter smaller than the peripheral surface 2*z* of the nozzle member 2. In this arrangement, in a status where the nozzle member 2 and the nozzle holder portion 3 are combined, a gap 40 is formed. As the small-diameter periphery 2*d* is provided, interference between an R portion remaining in the corner 3*d* upon formation of the cylindrical part 31 of the nozzle holder portion 3 and the corner 2*a* of the nozzle member 2 can be avoided. Further, in the present embodiment, the final seal performance is kept with the welded portion 5*a*. In this case, the pressure of the fuel leaked from the engagement portion between the corner 2*a* and the corner 3*a* does not influence the welded portion 5*a* until the fuel fills the gap 40. Accordingly, application of the high pressure of the fuel on the welded portion 5*a* at once can be avoided.

When the electromagnetic coil 43B is energized, the movable element 10 moves upward until the end surface (collision surface) 15*a* of the movable core 6 collides with the end surface (collision surface) 50*a* of the stationary core 50. The distance in which the movable element 10 can move in the central axis direction of the fuel injector, i.e., the amount of valve opening in the valve axis direction is referred to as a "stroke S". As the stroke S influences the amount of fuel injection flow, a fuel spray shape, valve-opening limit fuel pressure and the like as basic performances of the fuel injector in a sensitive manner, high accuracy adjustment by e.g. ±several μm is required. In the present embodiment, the stroke S of the movable element 10 is adjusted by adjusting the amount of engagement of the nozzle member 2 in the nozzle holder portion 3. The nozzle member 2 can be positioned with high accuracy with respect to the nozzle holder portion 3 by adjusting the amount of engagement. Further, as clear correlation can be established among the load to pressing the nozzle member 2, the amount of engagement and the stroke S, the stroke S can be easily controlled, and fine adjustment of the stroke S can be performed. Accordingly, high accuracy and efficient stroke adjustment can be realized. Further, as the nozzle member 2 is held with the plastic-deformed member of the nozzle holder portion 3, the nozzle member 2 is not moved when the nozzle member 2 and the nozzle holder portion 3 are fixed by laser welding, thus stroke change can be suppressed. Further, according to this method, a member for stroke adjustment such as a spacer can be omitted, thus the number of parts can be reduced.

Figure 4:
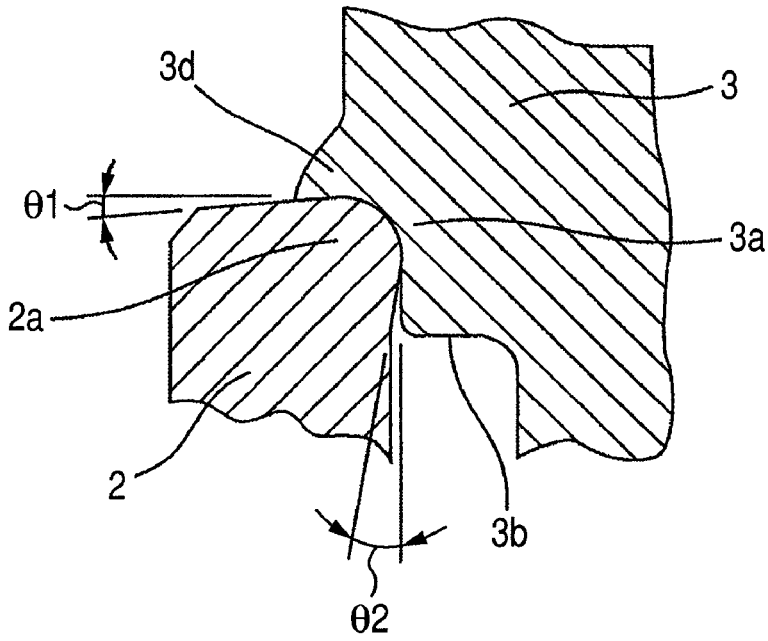
FIG. 4 is a cross-sectional view of another arrangement of the part A in FIG. 3.

FIG. 4 shows an example where the shape of the corner 2*a* of the nozzle member 2 to be engaged in the corner 3*a* of the nozzle holder portion 3 is changed. As in the case of FIG. 3, FIG. 4 is an enlarged cross-sectional view of the engagement portion between the nozzle holder portion 3 and the nozzle member 2. The other constituent elements than the engagement portion are the same as those in FIGS. 1 and 2.

The corner 2*a* of the end surface of the nozzle member 2 is provided with angles θ1 and θ2 such that the angle of the corner 2*a* becomes less than a right angle. In this arrangement, the pressing load upon formation of the crushed portion 3*d* by engagement of the corner 2*a* of the nozzle member 2 in the corner 3*a* of the nozzle holder portion 3 can be reduced. The present invention can be applied to a small lightweight fuel injector with small load capacity. Further, the angle θ2 further enhances holding of the nozzle member 2 in the pull-out direction by anchor effect.

Figure 5:
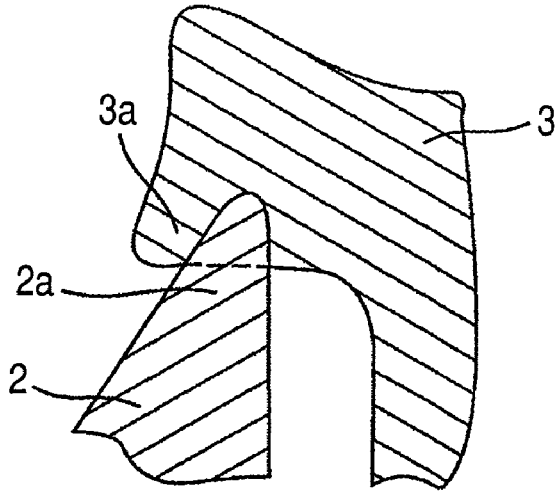
FIG. 5 is a cross-sectional view of another arrangement of the part A FIG. 3.
Figure 6:
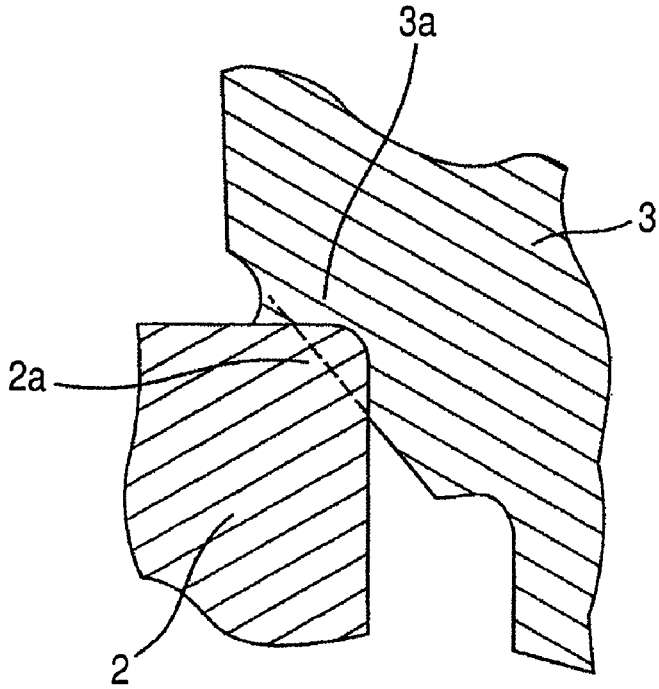
FIG. 6 is a cross-sectional view of another arrangement of the part A FIG. 3.

FIGS. 5 and 6 show other examples where the shape of the corner 2*a* of the nozzle member 2 to be engaged in the corner 3*a* of the nozzle holder portion 3 is changed. With the shapes as shown in FIGS. 5 and 6, similar advantages to those in the above-described embodiment can be expected.

The shapes of the corner 3*a* of the nozzle holder portion 3 and the corner 2*a* of the nozzle member 2 are not limited to the above-described examples. Further, in the embodiment, the nozzle member 2 is engaged in the nozzle holder portion 3. As the nozzle member 2 is provided with the valve seat 2*b*, it is desirable that the nozzle member 2 is made with hard material with excellent abrasion resistance. Accordingly, as the fuel injector, it is preferable that the nozzle member 2 is engaged in the nozzle holder portion 3. If production cost, production workability and the like are ignored, the relation of engagement may be reversed by e.g. forming the nozzle member with a combination of a valve seat member having a first material to form the valve seat 2*b* and a corner member to form the corner 2*a* of a second material softer than the valve seat member.

Second Embodiment

Figure 7:
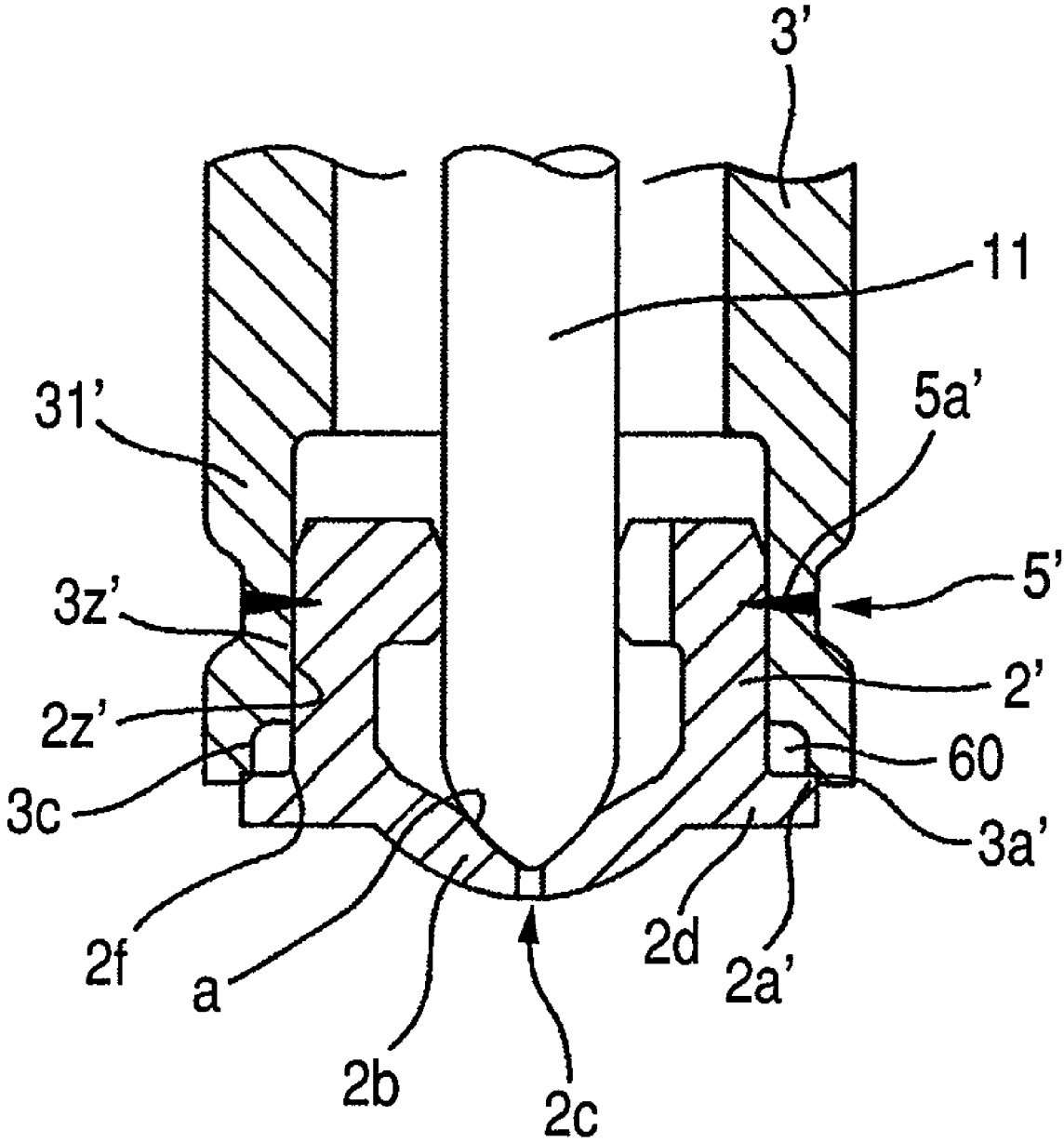
FIG. 7 is an enlarged cross-sectional view of a part of the fuel injector according to a second embodiment of the present invention.

FIG. 7 shows a second embodiment of the present invention. FIG. 7 is an enlarged cross-sectional view of the nozzle holder portion 3 with which the nozzle member 2 is assembled. Note that other constituent elements than those described below are the same as the elements in the first embodiment.

A periphery 2*z*' of a nozzle member 2' is pressed by a section of a length L into an inside 3*z*' of a nozzle holder portion 3'. At this time, a corner 2*a*' of a flange 2*d*, which is provided at the end side of the nozzle member 2', is engaged in a corner 3*a*' of the end side (an edge on the inside of the end surface) in a cylindrical part 31' of the nozzle holder portion 3'. By the engagement, the corner 3*a*' is plastic-deformed and a crushed portion is formed.

The end portion of the cylindrical part 31' is provided with an enlarged diameter portion 3*c*, thereby an annular gap 60 and a step portion are formed in the vicinity of the inner edge of the cylindrical part 31', and the corner 2*a*' of the nozzle member 2' is engaged in the corner 3*a*' of the nozzle lo holder portion 3'. The step portion formed with the enlarged diameter portion 3*c* forms a gap 60 between the nozzle member 2' and the nozzle holder portion 3'. A gap 60 functions as a clearance for accommodating an R portion formed by process of a corner 2*f* between the flange 2*d* of the nozzle member 2' and the periphery 2*z*'. Further, the gap 60 functions as the clearance for accommodating the plastic deformation of the corner 3*a*'. Thereby, the plastic deformation of the corner 3*a*' can be excellently made without being interrupted.

In the present embodiment, the corner 3*a*' that is plastic-deformed is provided at the end of the nozzle holder portion 3', however, it may be arranged such that another step portion is formed on an inner end side (inner edge) of the enlarged diameter portion 3*c* of the nozzle holder portion 3', and the corner 3*a*' is provided at the another step portion on the inner side of the nozzle holder portion 3'. In this arrangement, the end surface of the nozzle holder portion 3' and the end surface of the nozzle member 2' can be approximately aligned. Further, as described in the first embodiment, the side of plastic deformation may be the nozzle member 2' side.

In the present embodiment, the machining of the nozzle holder portion 3' can be more easily performed in comparison with the above-described embodiment, and further, high process accuracy can be obtained. Further, as the welded portion 5' is formed by sideways-lap welding, a margin for production management regarding positional shift of welding beam can be improved.

Next, the stroke adjustment for the fuel injector in the first and second embodiments will be described using FIGS. 8 and 9. Note that FIGS. 8 and 9 show the fuel injector of the first embodiment, however, the adjustment can be similarly performed in the fuel injector of the second embodiment.

Figure 8:
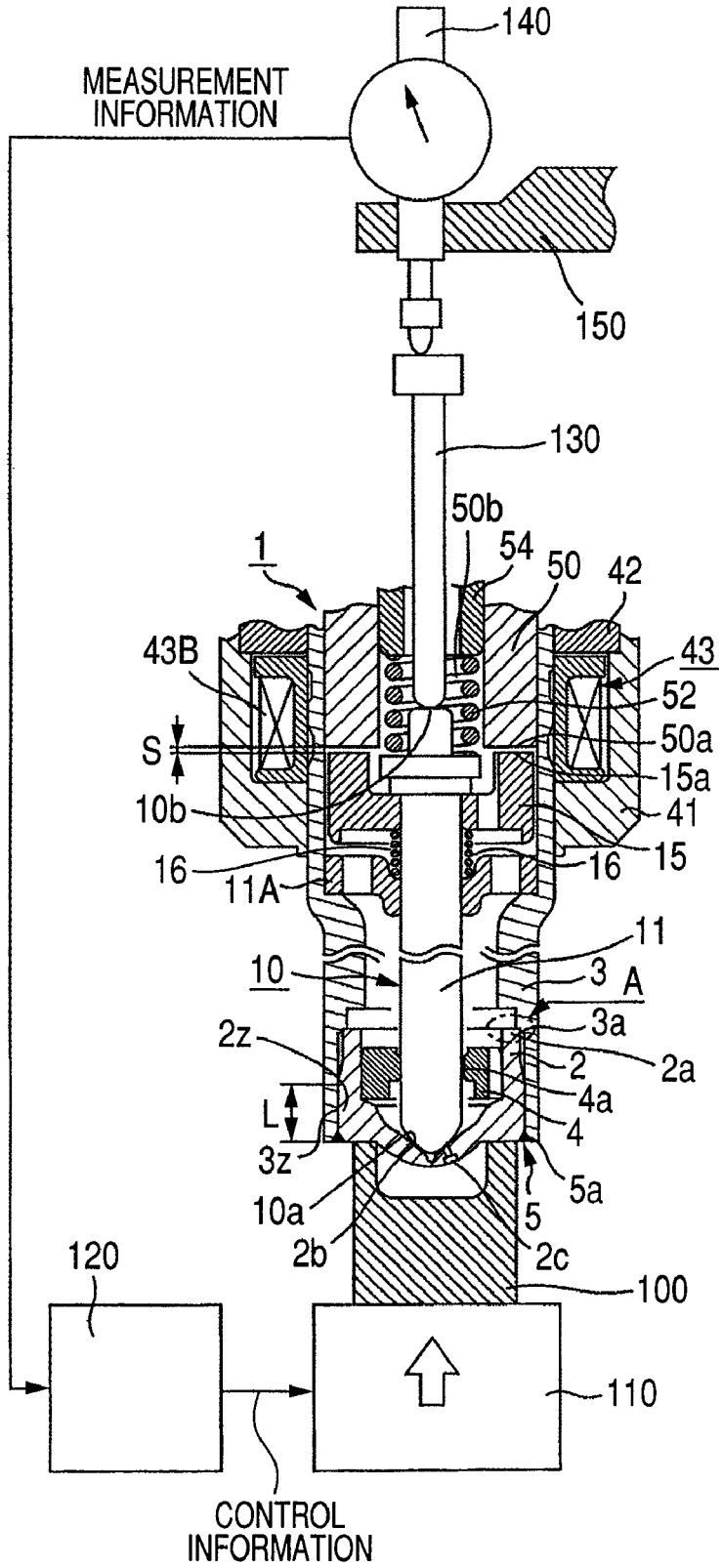
FIG. 8 illustrates the configuration of an apparatus to measure a movement amount of a movable element and adjust a stroke amount.
Figure 9:
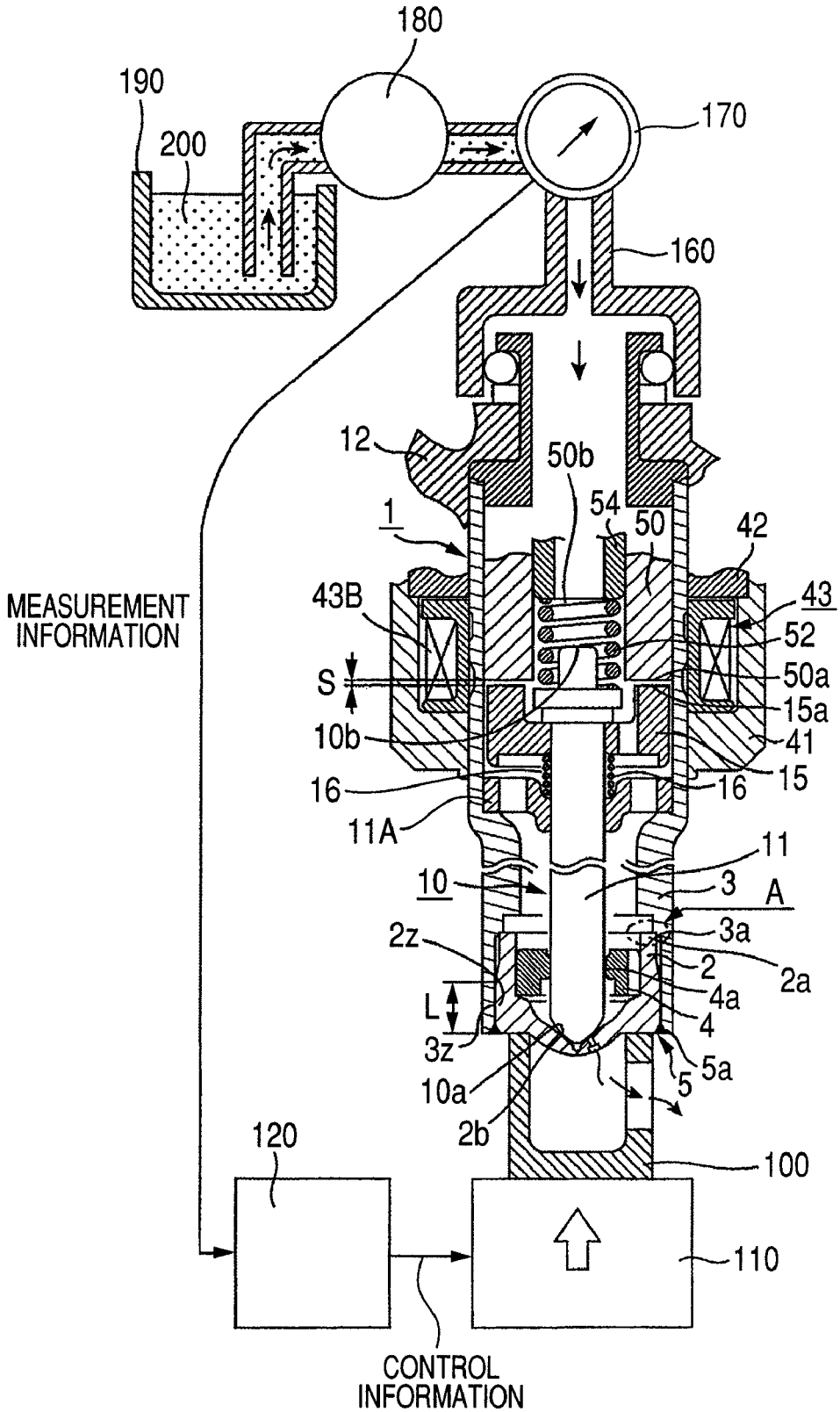
FIG. 9 illustrates the configuration of an apparatus to measure a flow amount of fuel flowing through the fuel injector and adjust a stroke amount.

FIG. 8 illustrates the configuration of an apparatus to measure a movement amount of a movable element and adjust a stroke amount.

In the stroke adjustment, in the last half of the assembly process before attachment of the fuel filter 62 and before execution of terminal mold 71, an upper end of the yoke (housing) 41 is received with a retainer jig and the nozzle member 2 is pressed with a pressing jig 100. Further, at this time, a spindle measuring element 130 for measuring the movement of the movable element 11 is brought into contact with an upper end 10*b* of the movable element 10 through a stationary core-hole 50*b*, and the movable element 10 is moved upward and downward using an electromagnetic coil 43B, thereby the stroke S of the movable element 10 is measured. The data is fed back for control of the amount of pressing of the nozzle member 2.

More particularly, the stroke adjustment is performed as follows. The stroke of the movable element 10 is measured with a measuring device 140 fixed to a fixing tool 150 via a measuring element 130. The measurement information is sent to a controller 120. The controller 120 calculates a pressing amount based on the stroke measurement information. The controller 120 generates a control signal based on the calculated pressing amount, and controls a pressing mechanism 110. The pressing mechanism 110 receives the control signal from the controller 120, and a pressing jig 100 presses the nozzle member 2. This cycle is repeated more than once, and the stroke is adjusted to a predetermined measurement.

With this method, a high performance fuel injector having high stroke accuracy can be assembled.

FIG. 9 illustrates the configuration of an apparatus to measure a flow amount of fuel flowing through the fuel injector and adjust a stroke amount.

The nozzle member 2 can be positioned with high accuracy by adjusting the flow amount in the fuel injector by changing the stroke S of the movable valve, by the adjustment of the amount of engagement. Further, as clear correlation is established among the load to pressing the nozzle member 2, the amount of engagement and the stroke S, and between the stoke S and the flow amount, control can be easily performed, and fine adjustment can be performed. Accordingly, high-accuracy and economically advantageous flow amount control can be performed.

More particularly, the stroke amount adjustment is performed as follows. The flow amount of liquid 200 to be sent to the fuel injector 1 with a pump 180 from a tank 190 is measured with a flow amount meter 170 connected to the fuel injector 1 via a piping 160 when the fuel injector is opened by energizing the electro magnetic coil 43B. The measurement information is sent to the controller 120. The controller 120 calculates the pressing amount based on the flow amount measurement information. The controller 120 generates a control signal based on the calculated pressing amount, and controls the pressing mechanism 110. The pressing mechanism 110 receives the control signal from the controller 120, and the pressing jig 100 presses the nozzle member 2. This cycle is repeated more than once, and the stroke is adjusted to a predetermined measurement.

The above-described embodiments have the following features.

In a fuel injector comprising a movable element, a seat contact surface formed at one end of the movable element, a nozzle member having a valve seat which the seat contact surface of the movable element is in contact with and seated on at the time of valve closing, and a nozzle holder portion to hold a periphery of the nozzle member, a plastic deformation portion, formed by engaging one of a part of the nozzle member and a part of the nozzle holder portion in the other of the part of the nozzle member and the part of the nozzle holder portion in a stroke direction of the movable element, is provided. The nozzle member and the nozzle holder portion are joined by welding.

As the plastic deformation portion formed by the engagement is provided between the nozzle member and the nozzle holder portion, the relative positional relation between the nozzle member and the nozzle holder portion can be maintained with the plastic deformation portion in excellent state upon welding. Accordingly, the stroke of the movable element is not easily changed.

Further, in a fuel injector comprising a movable element, a seat contact surface formed at one end of the movable element, a nozzle member having a valve seat which the seat contact surface of the movable element is in contact with and seated on at the time of valve closing, a nozzle holder portion to hold a periphery of the nozzle member, an electromagnetic circuit including a movable core provided at the other end of the movable element, a spring to press the movable element in a valve seat direction, an electromagnetic coil to attract the movable core and pull up the movable element with an attraction force overcoming a pressing force of the spring, and a stationary core, a pull-up limit position of the movable element is set by contact between the movable core and the stationary core;

a plastic deformation portion, formed by engaging one of a part of the nozzle member and a part of the nozzle holder portion in the other of the part of the nozzle member and the part of the nozzle holder portion in a stroke direction of the movable element, is provided.

As described above, the feature of the present invention has advantages in the structure where the pull-up limit position of the movable element is set by contact between the movable core and the stationary core and the seat contact surface of the movable element (valve head) is brought into contact and seated on the valve seat formed in the nozzle member. Namely, the amount of engagement is provided by the plastic deformation portion formed by engaging one of a part of the nozzle member and a part of the nozzle holder portion in the other one of the part of the nozzle member and the part of the nozzle holder portion in the stroke direction of the movable element. The amount of engagement has an effect on the stroke of the movable element. When the stroke is adjusted using the amount of engagement, a spacer for stroke adjustment can be omitted, and further, the stroke can be simply and infallibly adjusted.

What is claimed is:

1. A fuel injector comprising a movable element having a seat contact surface formed at one end of the movable element, a nozzle member having a valve seat which the seat contact surface of the movable element is in contact with and seated on at the time of valve closing, and a nozzle holder portion having a cylindrical part into which the nozzle member is inserted to hold a periphery of the nozzle member, wherein an inner surface of the cylindrical part of the nozzle holder portion has a step portion with an inside corner portion that overlaps with an outside corner portion of one end of the nozzle member, wherein the outside corner portion of the nozzle member engages into the inside corner portion of the step portion of the nozzle holder portion in a stroke direction of the movable element to thereby be provided with a plastic deformation portion at the inside corner portion of the step portion of the nozzle holder portion, wherein the nozzle member maintains a fixed status securely to the nozzle holder portion in the stroke direction of the movable element by the plastic deformation portion, wherein the nozzle member and the nozzle holder portion are joined by welding, and wherein the amount of engagement between the nozzle member and the nozzle holder portion is equal to or greater than 15 μm and equal to or less than 350 μm in an axial direction of the fuel injector, and the overlap amount thereof in a radial direction of the fuel injector is equal to or greater than 0.02 mm and equal to or less than 0.5 mm.

2. The fuel injector according to claim 1, wherein the nozzle member is press-fitted into the nozzle holder portion.

3. The fuel injector according to claim 1, wherein the nozzle member and the nozzle holder portion are joined and sealed with a ring-shaped welding bead at the location on the farther side of pressure transmission from the inside of the fuel injector than the plastic deformation portion.

4. A stroke adjustment method for the fuel injector according to claim 1, wherein a stroke of the movable element is adjusted by adjusting a flow amount by changing a valve opening amount of the movable element by adjusting the amount of engagement between the nozzle member and the nozzle holder portion.

5. A fuel injector comprising a movable element having a seat contact surface formed at one end of the movable element, a nozzle member having a valve seat which the seat contact surface of the movable element is in contact with and seated on at the time of valve closing, a nozzle holder portion having a cylindrical part into which the nozzle member is inserted to hold a periphery of the nozzle member, an electromagnetic circuit including a movable core provided at the other end of the movable element, a spring to press the movable element in a valve seat direction, an electromagnetic coil to attract the movable core and pull up the movable element with an attraction force overcoming a pressing force of the spring, and a stationary core, a pull-up limit position of the movable element is set by contact between the movable core and the stationary core;

wherein an inner surface of the cylindrical part of the nozzle holder portion has a step portion with an inside corner portion that overlaps with an outside corner portion of one end of the nozzle member, wherein the outside corner portion of the nozzle member engages into the inside corner portion of the step portion of the nozzle holder portion in a stroke direction of the movable element to thereby be provided with a plastic deformation portion at the inside corner portion of the step portion of the nozzle holder portion, wherein the nozzle member maintains a fixed status securely to the nozzle holder portion in the stroke direction of the movable element by the plastic deformation portion, wherein the nozzle member and the nozzle holder portion are joined by welding, and wherein the amount of engagement between the nozzle member and the nozzle holder portion is equal to or greater than 15 μm and equal to or less than 350 μm in an axial direction of the fuel injector, and the overlap amount thereof in a radial direction of the fuel injector is equal to or greater than 0.02 mm and equal to or less than 0.5 mm.

6. A stroke adjustment method for the fuel injector of claim 5, wherein a stroke of the movable element is adjusted by adjusting the amount of engagement between the nozzle member and the nozzle holder portion.

* * * * *